United States Patent [19]

Maloney

[11] 4,360,412

[45] Nov. 23, 1982

[54] TREATMENT OF PERMIONIC MEMBRANE

[75] Inventor: Bernard A. Maloney, Corpus Christi, Tex.

[73] Assignee: PPG Industries, Inc., Pittsburgh, Pa.

[21] Appl. No.: 207,594

[22] Filed: Nov. 17, 1980

[51] Int. Cl.[3] ..... C25B 1/34

[52] U.S. Cl. ..... 204/98; 204/128

[58] Field of Search ..... 204/98, 128, 282–283

[56] References Cited

U.S. PATENT DOCUMENTS

| | | | |
|---|---|---|---|
| 3,985,631 | 10/1976 | Hora et al. | 204/98 |
| 4,000,057 | 12/1976 | Mrazek et al. | 204/296 |
| 4,124,477 | 11/1978 | Tokawa et al. | 204/252 |
| 4,148,979 | 4/1979 | Asami et al. | 521/27 |
| 4,168,216 | 9/1979 | Burkhardt et al. | 204/98 |
| 4,311,567 | 1/1982 | White | 204/98 |

*Primary Examiner*—R. L. Andrews

*Attorney, Agent, or Firm*—Richard M. Goldman

[57] ABSTRACT

Disclosed is a method of starting up a permionic membrane chloralkali electrolytic cell by hydrolyzing the permionic membrane inside the cell. The permionic membrane is hydrolyzed by maintaining one side in contact with aqueous alkali metal hydroxide, and the opposite side in contact with aqueous alkali metal chloride, where the concentration of the alkali metal chloride is maintained low enough to avoid osmotic concentration of the alkali metal hydroxide solution.

6 Claims, No Drawings

TREATMENT OF PERMIONIC MEMBRANE

DESCRIPTION OF THE INVENTION

Chlorine and aqueous metal hydroxides may be industrially prepared in permionic membrane electrolytic cells. Permionic membrane electrolytic cells are characterized by the presence of a permionic membrane between the anolyte compartment and the catholyte compartment. The anolyte compartment, with a coated valve metal anode therein, contains an acidic, chlorinated brine anolyte, e.g., a sodium chloride brine anolyte or a potassium chloride brine anolyte. The catholyte compartment, on the opposite side of the permionic membrane, contains the cathode and an aqueous alkali metal hydroxide electrolyte, e.g., potassium hydroxide or sodium hydroxide.

The permionic membrane is a cation selective permionic membrane, that is, alkali metal ions, i.e., cations, such as potassium ion or sodium ion pass through the permionic membrane from the anolyte compartment to the catholyte compartment, while the passage of anions, i.e., chloride ions, from the anolyte compartment to the catholyte compartment, or hydroxyl ions from the catholyte compartment to the anolyte compartment, is substantially inhibited or eliminated by the cation selective groups of the permionic membrane.

Typically, the permionic membrane is a halogenated hydrocarbon, e.g., a fluorinated hydrocarbon, with pendant active groups. The pendant active groups are anionic groups having cation selectivity, such as sulfonyl groups, phosphonyl groups, and carboxyl groups. Most commonly they are carboxyl or sulfonyl groups. The groups are either acid groups or groups which may be converted to acid groups.

The catholyte facing side of the permionic membrane is in the alkali metal salt form during electrolysis, that is, it is in the form of a sodium salt of a carboxylic acid, a potassium salt of a carboxylic acid, sodium salt of a sulfonic acid, or a potassium salt of a sulfonic acid. The alkali metal salt form is not easily workable, being wet, strongly alkaline, and not readily heat-fusible or heat-sealable.

Preferably, the permionic membrane material is in a heat-sealable, hand-workable form when installed in the cell, for example, a low alkyl ester of carboxylic acid, or an acid halide of a carboxylic acid, a sulfonic acid, or a phosphonic acid.

The ester, acid halide, or hydrogen acid form of the permionic membrane must be hydrolyzed before electrolysis can begin. The hydrolysis may occur before fabrication, after fabrication but before installation in the cell, or after fabrication and after installation in the cell.

Hydrolysis in situ, that is, hydrolysis after fabrication and installation in the cell, offers various advantages. For example, it allows cell installation personnel to work with the ester form rather than the sodium salt or potassium salt form of the permionic membrane, and it allows the membrane to be dry, or if wet, to be wet with materials that do not require special handling. However, hydrolysis with one side contacting the brine and the other side contacting an alkaline solution, as catholyte, gives rise to problems such as blistering, high chlorate content in the anolyte liquor, and the presence of high levels of impurities, as oxygen and hydrogen in the chlorine gas. It is, therefore, necessary to carry out hydrolysis in a manner as as to minimize the aforementioned problems.

It has now been found that in situ hydrolysis may be carried out by providing alkali metal chloride brine in the anolyte compartment, and aqueous alkali metal hydroxide in the catholyte compartment, where the concentration of alkali metal hydroxide in the catholyte compartment is maintained low enough to avoid damage to the membrane, both during hydrolysis and consequent damage during subsequent electrolysis, resulting in a high voltage, but high enough to avoid overswelling of the permionic membrane with consequent low current efficiency. That is, the alkalinity is maintained between about 8 to 12 mole percent, basis mole of water in the catholyte, until the functional groups are substantially hydrolyzed to the alkali metal form. The concentration of alkali metal ion in the anolyte compartment is maintained low enough to provide water to the membrane, thereby providing controlled swelling of the membrane. As herein contemplated, the hydrolysis may be monitored by monitoring the pH of the anolyte liquor and not commencing hydrolysis until after the anolyte liquor pH has obtained a minimum and starts to increase. In a particularly preferred exemplification, the membrane electrical resistance may be monitored and electrolysis commenced after the membrane electrical resistance reaches a desired value, for example, under about 1 ohm.

DETAILED DESCRIPTION OF THE INVENTION

Applicant's invention relates to chlor-alkali electrolysis in a permionic membrane cell and particularly to a method of starting up the cell, that is, of readying the cell to commence electrolysis by hydrolysis of the permionic membrane.

Permionic membrane electrolytic cells are characterized by an anolyte compartment with an anode and anolyte liquor therein, a catholyte compartment with a cathode and catholyte liquor therein, and a permionic membrane therebetween. Typically, the anode is a coated metal anode having a valve metal substrate with a catalytic coating thereon. Chlorine is evolved at the anode according to the reaction:

$$Cl^- \rightarrow \tfrac{1}{2}Cl_2 + 1e^-$$

The anolyte liquor is the brine feed acidified and chlorinated within the cell. Typically, the brine feed is concentrated, even saturated brine, and may be acidic, neutral, or alkaline. Most frequently it is alkaline. The brine feed, typically contains about 4.5 to about 11 mole percent alkali metal chloride, that is, about 15 to about 26 weight percent sodium chloride, or about 17 to about 35 weight percent potassium chloride. The anolyte liquor typically has 25 to 75 percent brine depletion and is at a pH of from about 2.5 to about 5.5.

The catholyte compartment contains a metal cathode. It may optionally have a coating, such as nickel, lead oxide, or the like. Hydroxide ion and, when an oxidant is not separately fed to the catholyte compartment, hydrogen, are evolved at the cathode. The catholyte liquor is an alkali metal hydroxide, substantially free of chlorine, and containing from about 5 to about 28 mole percent alkali metal hydroxide, i.e., from about 10 to about 45 weight percent sodium hydroxide, or from about 13 to about 55 weight percent potassium hydroxide.

Interposed between the anolyte compartment and the catholyte compartment is a permionic membrane. The permionic membrane is cation selective. That is, it blocks the flow of chlorine from the anolyte to the catholyte, and the flow of hydroxide ion from the catholyte to the anolyte, while permitting the flow of cations, i.e., sodium ions or potassium ions. During normal electrolysis the flow of alkali metal ions is from the anolyte to the catholyte. Moreover, the permionic membrane maintains a pH differential between the anolyte liquor and the catholyte liquor with the anolyte liquor having a pH of from about 2.5 to about 5.5 and the catholyte liquor containing from about 5 to about 28 mole percent alkali metal hydroxide.

In the permionic membrane electrolytic cell process for the production of chlorine and alkali metal hydroxide, brine is fed to the anolyte compartment and depleted brine is recovered therefrom, while either water or dilute alkali metal hydroxide is fed to the catholyte compartment, and concentrated alkali metal hydroxide, i.e., concentrated sodium hydroxide or potassium hydroxide is recovered therefrom. An electrical current passes from the anode to the cathode, evolving chlorine at the anode and hydroxyl ion at the cathode.

Chlorine gas is recovered from the anolyte compartment with aqueous alkali metal hydroxide, i.e., aqueous potassium hydroxide or sodium hydroxide, being recovered from the catholyte compartment.

The electrodes may be planar electrodes, as in a pancake type cell, or fingered, interleaved electrodes. The permionic membrane is supported by one electrode, most commonly by the cathode, although it may, alternatively, be supported by the anode. Alternatively, anodic electrocatalyst or cathodic electrocatalyst or both may contact the permionic membrane, as in a solid polymer electrolyte cell where electrocatalyst is bonded to the permionic membrane or in a zero gap permionic membrane cell wherein the anodic electrocatalyst or the cathodic electrocatalyst or both removably contact the permionic membrane. In a permionic membrane electrolytic cell having fingered electrodes, the permionic membrane is typically a sheet or plurality of sheets that are formed into the shape of the electrode surface upon which they are carried, i.e., formed into the shape of a fingered electrode and thereafter sealed to form an electrolyte-tight, gas-tight shaped structure. Typically the sealing is by heat-sealing.

Preferably, where fabrication of the membrane, including sealing is required, the membrane is in the acid, ester, or acid halide form. It may be dry, or swollen by suitable solvents as water, brine, or organic solvents such as alcohols, aldehydes, ketones, ethers, and esters.

When the membrane is installed in the cell, one side of the permionic membrane faces the anolyte compartment and the anode. The anolyte compartment contains body parts, including the anode, which may be harmed by concentrated, alkaline, alkali metal hydroxide solutions. The opposite side of the permionic membrane faces the catholyte and the cathode. The catholyte compartment body parts and the cathode may be harmed by anolyte liquor.

It is necessary to hydrolyze the permionic membrane from the hydrogen acid, ester, or acid halide form prior to commencing electrolysis. This is in order to avoid blistering, high anode gas oxygen and hydrogen content, and high anolyte chlorate contents during subsequent electrolysis. However, the hydrolysis must be carried out without subjecting the anolyte compartment to catholyte liquor or the catholyte compartment to anolyte liquor.

The method of this invention avoids maintaining cells at different current densities in a multielectrolytic cell plant, that is, where the cells are electrically in series.

According to the method herein contemplated, the permionic membrane is hydrolyzed in situ by providing dialysis. As herein contemplated, the dialysis across the permionic membrane is enhanced by maintaining the concentrations of alkali metal ions, i.e., sodium ions or potassium ions, in both the anolyte and catholyte liquors at levels to maintain the concentration thereof in the catholyte liquor high enough to provide dialysis without over swelling of the membrane and consequent low current efficiency, but low enough to avoid over hydrolysis, evidenced by blistering or damage to the membrane on subsequent cell start-up and consequent high voltage, i.e., between about 8 to 12 mole percent alkali metal hydroxide in the catholyte liquor.

As herein contemplated, the catholyte is maintained below about 12 mole percent alkali metal hydroxide basis moles of water, i.e., below about 30 weight percent sodium hydroxide or about 43 weight percent hydroxide. This avoids damage to the permionic membrane, e.g., excessively rapid hydrolysis, with catholyte alkali metal hydroxide contents above about 18 mole percent, being associated with subsequent blistering of the permionic membrane, and high anolyte liquor chlorate contents, and high cell voltages. However, the catholyte alkali metal ion content should be high enough to provide a source of cations under alkaline conditions to hydrolyze the permionic membrane while avoiding overswelling of the permionic membrane, i.e., above about 8 percent alkali metal hydroxide. This is accomplished by controlling the alkali metal ion concentration in the anolyte compartment. The alkali metal ion concentration in the anolyte compartment is maintained low enough to avoid osmotic or a dialytic transport of sodium ions from the anolyte to the catholyte, but high enough to avoid dilution of the catholyte by osmosis or dialysis of cations, i.e., sodium ions or potassium ions, from the catholyte to the anolyte. Typically the anolyte contains from about 15 to about 26 weight percent sodium chloride, or about 19 to about 35 weight percent potassium chloride. Typically the catholyte contains above about 18 weight percent sodium hydroxide, and below about 30 weight percent sodium hydroxide, or above about 25 weight percent potassium hydroxide and below about 43 weight percent potassium hydroxide.

The method of this invention may be carried out, in a preferred exemplification, by monitoring the pH of the anolyte overflow. Where the brine is purified brine, typically at an alkaline pH of about 8 to 9, the brine will become more alkaline with time. The anolyte overflow pH initially varies only slightly, i.e., due to normal variations in the brine feed pH. During hydrolysis, the electrical resistance of the permionic membrane begins to decrease. The anolyte overflow pH increases, e.g., to pH 10. This indicates breakthrough of diffusing hydroxide ion from the catholyte compartment, and a further decrease in the electrical resistance of the permionic membrane.

During this time sequence, the electrical resistance, i.e., the produce of electrical resistivity times membrane thickness, divided by membrane area, of the permionic membrane, measured from electrode lead to electrode lead, in a 5 inch by 7 inch cell decreases by two orders of magnitude, i.e., from an initial electrical resistance within the range of 100 to 1000 kilo-ohms initially to less than about 1 ohm after complete hydrolysis. Electrolysis can begin after hydrolysis has progressed enough to avoid significant damage to the permionic membrane, as evidenced by either direct resistance measurements or by the increase in anolyte pH. However, it is preferable to wait until there has been substantially complete hydrolysis. That is, until the apparent electrical resistivity of the permionic membrane is under 8000 ohm-centimeters, e.g., about 1.2 ohms for a 0.029 centimeter thick, 226 square centimeter permionic membrane.

The time for substantially complete hydrolysis and the temperature at which hydrolysis is carried out are interrelated. That is, the lower the temperature the longer the time required for substantially complete hydrolysis, while the higher the temperature the shorter the time required for substantially complete hydrolysis. Generally a temperature of about 80 to 90 degrees centigrade is preferred for hydrolysis. This temperature is low enough to avoid boiling of electrolyte and approximates the temperature of operational cells, and is within the normal design parameters of the material of construction used in the cell.

Generally about 4 to 48 hours is required for the increase of pH of the anolyte overflow, which correlates with a 6 to 8 order of magnitude decrease in electrical resistance of the permionic membrane, i.e., substantially complete hydrolysis thereof, as evidenced by a permionic membrane electrical resistivity less than about 8000 ohm-centimeters.

According to one exemplification of this invention, a zero gap permionic membrane cell may be provided having the anode electrocatalyst removably in contact with and bearing upon the anolyte facing surface of the permionic membrane, and the cathode electrocatalyst removably in contact with and bearing upon the catholyte facing surface of the permionic membrane. As herein contemplated, the anodic electrocatalyst is metallurgically bonded to a metallic, electrically conductive substrate and the assembly of substrate and electrocatalyst is readily removable from the surface of the permionic membrane while the cathode electrocatalyst is metallurgically bonded to a metallic, electroconductive, catholyte resistant substrate, which cathode assembly of catalyst and substrate is readily removable from the surface of the permionic membrane. As herein contemplated, the electrolytic cell is assembled with the anode and cathode holding the permionic membrane in place, the permionic membrane being in the form of an ethyl ester of a perfluorinated carboxylic acid ion exchange resin material. Thereafter, 26 weight percent aqueous sodium hydroxide is fed to the catholyte compartment, and 17 weight percent aqueous sodium chloride is fed to the anolyte compartment. Anolyte and catholyte are continually removed from the respective compartments and replenished with 17 weight percent sodium chloride in the anolyte compartment, and 26 weight percent sodium hydroxide in the catholyte compartment. The anolyte feed is pH 8.2 sodium chloride, and the anolyte overflow is continuously measured. After about 24 hours, the anolyte overflow is at a pH of 10.2 and the electrical resistivity of the permionic membrane is approximately 8000 ohm-centimeters. At this time, electrolysis is commenced, with chlorine being evolved at the anode, and hydrogen being evolved at the cathode.

According to an alternative exemplification of the method of this invention, a solid polymer electrolyte electrolytic cell is assembled. The solid polymer electrolyte is prepared by depositing cathodic electrocatalyst for example, finely divided metal or metallic oxide material, on the catholyte facing side of the permionic membrane, and anodic electrocatalyst on the anolyte facing surface of the permionic membrane. The permionic membrane is in a thermoplastic form, e.g., a methyl or ethyl ester of a perfluorinated carboxylic acid ion exchange material. The electrocatalyst particles are bonded to the permionic membrane to form the solid polymer electrolyte by heating the permionic membrane to a temperature at which it exhibits thermoplastic properties and compressing the electrocatalyst particles therein. The solid polymer electrolyte is then installed in an electrolytic cell between an anode current collector, which conducts electrical current from cell leads to the anodic electrocatalyst, and a cathodic current collector which conducts electrical current between cell leads and the cathodic electrocatalysts. The anolyte compartment is charged with 26 weight percent potassium chloride at a pH of 8.2 and the catholyte compartment is charged with 42 weight percent potassium hydroxide. Continuous overflow of anolyte and catholyte is provided. After approximately 36 hours, the anolyte overflow is at a pH of about 10.4 and the solid polymer electrolyte has an electrical resistivity of under 8000 ohm-centimeters. Thereafter, electrolysis is commenced.

According to a still further method of this invention, a permionic membrane may be installed on a fingered cathode electrolytic cell, i.e., an electrolytic cell having fingered cathodes interleaved between complimentary fingered anodes. The permionic membrane is a sheet in the form of a methyl ester of a perfluorinated carboxylic acid. The sheet is cut to form a glove around the cathode fingers and then heat sealed in a hot press to form a closed, electrolyte-tight, gas-tight glove. The glove is installed on the fingered cathode assembly, and the fingered cathode assembly and fingered anode assembly are assembled to form an electrolytic cell. The resulting electrolytic cell is charged with 18 weight percent sodium chloride in the anolyte compartment, and 25 weight percent sodium hydroxide in the catholyte compartment at a temperature of about 90 degrees centigrade. The electrolytes are maintained at about 90 degrees centigrade for about 48 hours with continuous anolyte and catholyte overflow. Throughout this time the catholyte content of the catholyte is maintained below about 26 weight percent sodium hydroxide. After about 18 hours, the electrical resistance of the permionic membrane is measured and found to be approximately 0.6 to 1 ohm. Thereafter, electrolysis is commenced with evolution of chlorine at the anode and sodium hydroxide in the catholyte liquor and hydrogen at the cathode.

The method of this invention may be used in the manufacture and assembly of various permionic membrane electrolytic cells for chlor alkali production. For example, it may be used for fingered cells, or flat plate cells, for zero gap permionic membrane cells, and for solid polymer electrolyte electrolytic cells.

The following examples are illustrative:

EXAMPLE I

A permionic membrane was hydrolyzed in situ, and thereafter used for electrolysis of brine.

An electrolytic cell was prepared having 5 inch by 7 inch by $\frac{7}{8}$ inch anolyte and catholyte compartments, prepared from $\frac{5}{8}$ inch thick colorinated polyvinyl chloride. The cathode was a 2.5 mesh by 5 mesh to the rod steel substrate with a nickel-molybdenum surface. The anode was a 2.5 mesh by 5 mesh to the rod titanium substrate with a coating of platinum and iridium, and was one quarter inch from the cathode.

The cation selective permionic membrane was a sheet of ASAHI Glass Co. FLEMION®, perfluorinated carboxylic acid. The membrane was in the methyl ester form.

The cell was assembled. The anolyte compartment was filled with 17 weight percent aqueous sodium chloride having a pH of 8.2, the catholyte compartment was filled with 27.7 weight percent aqueous sodium hydroxide. The anolyte feed was 9.5 cubic centimeters per minute of 25.5 weight percent sodium chloride, and 5.9 cubic centimeters per minute of water. The electrolyte compartments were heated to approximately 88 to 90 degrees centigrade.

The initial membrane resistivity after about 5 minutes of hydrolysis was approximately 5 megaohm-centimeters. After 19 hours of hydrolysis, the anolyte pH was 10.5 and the membrane resistivity was approximately 3500 ohm-centimeters.

EXAMPLE II

A permionic membrane was hydrolyzed in situ, and thereafter used for electrolysis of brine.

An electrolytic cell was prepared having 5 inch by 7 inch by $\frac{7}{8}$ inch anolyte and catholyte compartments, prepared from $\frac{5}{8}$ inch thick chlorinated polyvinyl chloride. The cathode was 2.5 by 5 mesh to the inch 316 stainless steel. The anode was a 7.5 by 5 mesh to the inch titanium substrate with a coating of ruthenium dioxide and titanium dioxide), and was one quarter inch from the cathode.

The cation selective permionic membrane was a sheet of Asahi Glass Co. FLEMION®, perfluorinated carboxylic acid. The membrane was in the methyl ester form.

The cell was assembled. The anolyte compartment was filled with 26 weight percent aqueous sodium chloride having a pH of 8.2, and the catholyte compartment was filled with 25 weight percent aqueous sodium hydroxide. The electrolyte compartments were heated to approximately 88 to 90 degrees centigrade.

The anolyte pH initially increased from 8.2 to 8.6, and thereafter dropped slowly, for a period of 7 hours, attaining a pH of 8.1. During this time, the resistivity of the membrane measured through the electrode leads dropped to about 18,000 ohm-centimeters.

Thereafter, the anolyte pH increased from pH 8.1 to pH 10.8 over a period of 40 hours. During this time the resistivity of the membrane, measured through the electrode leads dropped to under 3000 ohm-centimeters.

Thereafter, electrolysis was commenced.

While the invention has been described with respect to certain exemplifications and embodiments thereof, the extent thereof is not intended to be limited thereby, but only by the claims appended hereto.

I claim:

1. In a method of operating an electrolytic cell having an anolyte compartment, a catholyte compartment, and a cation selective permionic membrane therebetween, wherein said cation selective permionic membrane is a fluorocarbon resin having cation selective functional groups, said cation selective functional groups being in the ester or hydrogen acid form prior to electrolysis and in the alkali metal salt form during electrolysis, which method comprises feeding alkali metal chloride brine to the anolyte compartment, passing an electrical current through the cell, and evolving chlorine, the improvement comprising:

(a) feeding alkali metal chloride brine to the anolyte compartment prior to the passage of current through the cell;

(b) feeding aqueous alkali metal hydroxide to the catholyte compartment prior to the passage of current through the cell;

(c) maintaining the concentration of said alkali metal hydroxide in the catholyte compartment between about 8 to 12 mole percent, basis moles of water, until said functional groups are substantially hydrolyzed in situ to the alkali metal salt; and (d) thereafter commencing electrolysis.

2. The method of claim 1 comprising maintaining the concentration of alkali metal ion in the anolyte compartment low enough to maintain the concentration of alkali metal hydroxide in the catholyte compartment between about 8 to 12 mole percent.

3. The method of claim 1 comprising commencing electrolysis after the anolyte liquor pH begins to increase.

4. The method of claim 1 wherein the cation selective groups are carboxylate groups, and the alkali metal salt is an alkali metal carboxylate.

5. In a method of operating an electrolytic cell having an anolyte compartment, a catholyte compartment, and a cation selective permionic membrane therebetween, wherein said cation selective permionic membrane is a fluorocarbon resin having cation selective functional groups, said cation selective functional groups being in the ester or hydrogen acid form prior to electrolysis and in the alkali metal salt form during electrolysis, which method comprises feeding alkali metal chloride brine to the anolyte compartment, passing an electrical current through the cell, and evolving chlorine, the improvement wherein the permionic membrane is dialytically hydrolyzed by the method comprising:

(a) feeding alkali metal chloride brine to the anolyte compartment prior to the passage of current through the cell;

(b) feeding aqueous alkali metal hydroxide to the catholyte compartment prior to the passage of current through the cell;

(c) maintaining the concentration of said alkali metal hydroxide in the catholyte compartment between about 8 to 12 mole percent, basis moles of water, until the anolyte liquor pH begins to increase; and (d) thereafter commencing electrolysis.

6. The method of claim 5, wherein the cation selective groups are carboxylate groups, and the hydrolysis product is an alkali metal carboxylate.

* * * * *